US006769135B1

(12) United States Patent
Monroe

(10) Patent No.: US 6,769,135 B1
(45) Date of Patent: Aug. 3, 2004

(54) HAIR CUTTING CAPE WITH FOOT COVERING

(76) Inventor: Kimberly Anne Monroe, 1884 Long Bridge La., Virginia Beach, VA (US) 23454

( * ) Notice: Subject to any disclaimer, the term of this patent is extended or adjusted under 35 U.S.C. 154(b) by 0 days.

(21) Appl. No.: 10/441,180

(22) Filed: May 20, 2003

(51) Int. Cl.[7] ..... A41D 13/04
(52) U.S. Cl. ..... 2/50
(58) Field of Search ..... 2/48, 49.1, 49.2, 2/49.3, 49.4, 49.5, 104, 50, 51, 52, 174, 172, 69, 69.5, 88, 89, 86; 4/519, 523; 132/212; 5/494, 663

(56) References Cited

U.S. PATENT DOCUMENTS

| | | | | | |
|---|---|---|---|---|---|
| 1,482,777 | A | * | 2/1924 | Becton | 2/24 |
| 1,614,126 | A | * | 1/1927 | Hart | 2/48 |
| 2,224,746 | A | * | 12/1940 | Richstein | 2/48 |
| 4,873,725 | A | * | 10/1989 | Mitchell | 2/48 |
| 5,283,909 | A | * | 2/1994 | Hill | 2/69 |
| 5,437,061 | A | * | 8/1995 | Kenner | 2/69 |
| 5,457,820 | A | * | 10/1995 | Yielding | 2/49.1 |
| 5,604,932 | A | * | 2/1997 | Lawicki | 2/69.5 |
| 5,621,916 | A | * | 4/1997 | Bell | 2/48 |
| 5,956,766 | A | * | 9/1999 | Benway | 2/69 |
| 6,036,260 | A | * | 3/2000 | Mullen | 297/184.13 |
| 6,081,923 | A | * | 7/2000 | Marks | 2/49.3 |
| 6,219,847 | B1 | * | 4/2001 | Aikins | 2/69 |
| 6,345,392 | B1 | * | 2/2002 | Rios | 2/48 |
| 6,532,595 | B1 | * | 3/2003 | Holmes | 2/48 |
| 6,643,870 | B2 | * | 11/2003 | Bertrand | 5/482 |
| 2002/0166155 | A1 | * | 11/2002 | Katz | 2/48 |
| 2003/0088902 | A1 | * | 5/2003 | Levy | 2/50 |

OTHER PUBLICATIONS

Gershman, Maurice:Velcro Digest: Journal of AMA, vol. 168, No. 7, Self–Adhering Nylon Tapes, p. 930, Oct. 1958.*

* cited by examiner

*Primary Examiner*—John J. Calvert
*Assistant Examiner*—Alissa L. Hoey
(74) *Attorney, Agent, or Firm*—Stites & Harbison, PLLC; Ross F. Hunt, Jr.

(57) ABSTRACT

A hair cutting cape for us in cutting the hair of a patron includes a protective covering for protecting the feet, and thus the shoes, of the patron from falling hair. A main portion of the cape includes a neck opening for the head of the patron. The foot covering portion is secured to the lower front edge of the main portion of the cape and extends outwardly from that edge so that, in use of the cape, the foot covering portion can be slipped over the feet and around the foot bar of the hair cutting chair in which the patron is seated so as to protect the shoes of the patron from falling hair.

10 Claims, 1 Drawing Sheet

HAIR CUTTING CAPE WITH FOOT COVERING

FIELD OF THE INVENTION

The present invention relates to capes or smocks used in hair styling salons to protect a patron from falling hair and, more particularly, to a cape of this type which also protects the shoes of a wearer of the cape from falling hair.

BACKGROUND OF THE INVENTION

A problem of long standing in hair styling salons is that of hair that has been cut from the head of a patron or customer dropping or falling into the shoes of the patron. This can happen when the hair is first cut or when the hair collects on the hair cutting cape or smock and later falls into the shoes as the patron shifts in the chair, or otherwise moves, and the hair then slides down and off the cape. Hair when it gets into the shoes can be difficult to get out and the process of attempting to remove the hair can be annoying to both the patron and the hair stylist.

Although it would be possible to combat this problem by simply providing a larger, i.e., longer cape, such oversized capes are cumbersome and relatively heavy, and uncomfortable to wear. Further, while other techniques have been used to attempt to capture the fallen hair, such as capes with built-in hair catching features, these have not proved to be entirely successful and are not popular with some patrons.

SUMMARY OF THE INVENTION

In accordance with the invention, there is provided a cape or smock for use during hair cutting that includes a foot covering portion for protecting the shoes of a patron against hair falling onto or into the shoes. The foot covering portion of the cape of the invention enables the shoes to be protected in a simple manner that is not confining or uncomfortable, in contrast, for example, to an oversized cape. The cape of the invention is extremely easy to use and is also easy to make. In the latter regard, existing capes can be readily modified to incorporate the foot covering of the invention. Alternatively, a cape incorporating such a foot covering can be readily and easily made.

In accordance with one aspect of the invention, there is provided a hair cutting cape for use in cutting the hair of a person seated in a hair cutting chair including a foot bar on which the feet of the person rest, the hair cutting cape comprising:

- a main portion including a neck opening through which extends the head of the person whose hair is being cut, said main portion including first and second opposed edges and third and fourth opposed edges, and said opening being disposed within said main portion at a location substantially equally spaced from said third and fourth edges and being spaced from the first edge an amount such that, in use of the cape, substantial portions of the cape fall over both the front and back of the person, and
- a foot covering portion extending outwardly from said second edge so that, in use, the foot covering portion can be slipped around the foot bar so as to protect the feet of the person from falling hair.

Preferably, the main portion of the cape is substantially rectangular in shape.

Preferably, the main portion includes a slit extending from said first edge to the neck opening. In an advantageous implementation, portions of the main portion adjacent to said slit include hooks and loops fasteners for securing the opposed portions together.

Advantageously, the foot covering portion is disposed centrally of said second edge of the main portion.

In one preferred embodiment, the foot covering portion has a free end of a substantially semicircular shape. In another preferred embodiment, the foot covering portion is of a substantially rectangular shape. In embodiments wherein the foot covering portion is tapered or non-rectangular, the foot covering portion is preferably of decreasing width in a direction away from the second edge.

Advantageously, the foot covering portion has a maximum width less than one-half of that of said second edge.

The foot covering portion must be long enough to readily cover the feet of a typical patron and preferably has a length of between 10 and 13 inches.

According to a further aspect of the invention, there is provided a hair cutting cape comprising:

- a main portion including a neck opening through which extends the head of a person whose hair is being cut, the main portion including first and second substantially opposed edges and third and fourth substantially opposed edges, and said neck opening being disposed within the main portion at a location substantially equally spaced from the third and fourth edges, said main portion being of such a size and said neck opening being spaced from said second edge by such an amount that, in use of the cape, substantial portions of the cape fall over both the front and back of the person, and
- a foot covering portion secured to said second edge of said main portion centrally thereof and extending outwardly from said second edge an amount such that, in use, the foot covering portion, when placed over the feet of the person, can cover the feet of the person and thus protect the shoes of the person from falling hair.

In addition, this aspect of the invention preferably incorporates one or more of the various preferred or advantageous features discussed above in connection with the first aspect of the invention.

Further features and advantages of the present invention will be set forth in, or apparent from, the detailed description of preferred embodiments thereof which follows.

DESCRIPTION OF THE PREFERRED EMBODIMENTS

Figure 1:
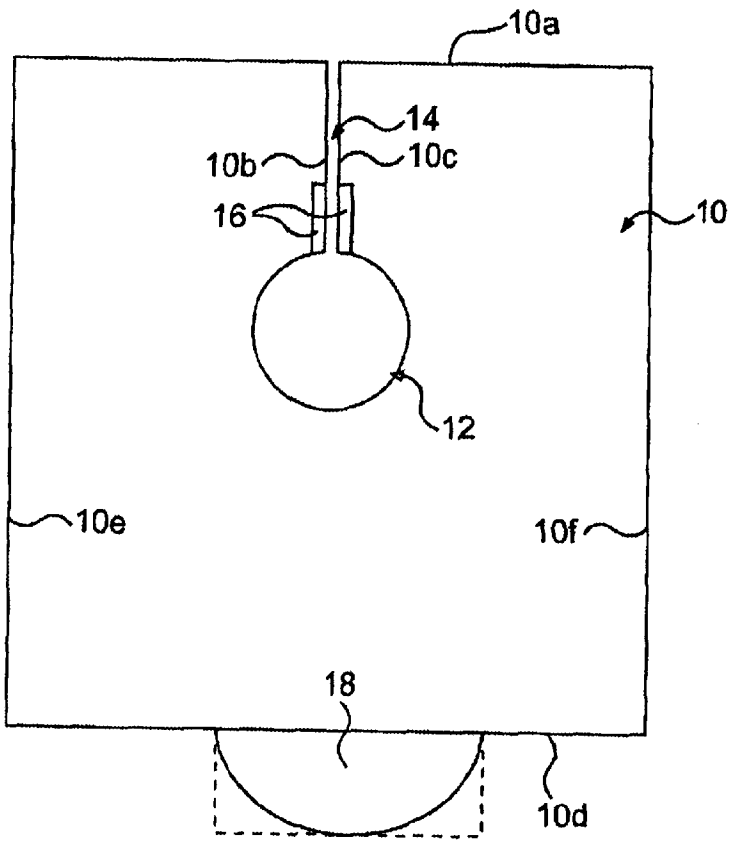
FIG. 1 is a top plan view of a hair cutting cape in accordance with a preferred embodiment of the invention.

Referring to FIG. 1, there is shown a plan view of a preferred embodiment of the hair cutting cape of the invention. The cape, which is generally denoted 10, is typically of a rectangular shape although other shapes are possible. A neck opening 12, typically of a circular shape, is provided generally centrally of the cape 10. A slit or slot 14 extends between neck opening 12 and one side edge 10*a* of cape 10, with the slit 14 being formed or defined by facing or opposing edges 10*b* and 10*c*. Complementary hooks and loops (VELCRO®) fasteners or fastener strips 16 are secured to the opposed edges 10*b* and 10*c* to portions of the neck opening 12 so as to permit the cape 10 to be closed about the neck of a patron or other wearer of the cape 10 so that the cape stays in place.

As indicated above, a key feature of the present invention is the provision of a cape with a foot covering for covering the shoes of a patron during hair cutting so as to prevent cut hair from falling into or onto the shoes of the patron. To this end, a foot covering, generally denoted 18, is secured to, or formed integrally, with a further side edge 10*d* of cape 10 opposite to edge 10*a* so as to be substantially equispaced from the remaining side edges 10*e* and 10*f*. As indicated in FIG. 1, covering 18 may be substantially in the shape of a flattened semicircle, as shown in solid lines, or may simply be of a rectangular shape, as shown in dashed lines.

To provide a general idea of the dimensions of cape 10 and foot covering 18, in a specific non-limiting example, the cape is 53 inches wide and 65 inches long and the neck opening 12 is 22 inches, the hooks and loops fastener strips 16 are 6 inches long, and slit 14 is 15 inches long. In this example, the foot covering 18 is 26 inches wide and 11 inches long, and thus the width of covering 18 is somewhat less than one-half of the width of cape 10. The length of the foot covering 18 is important in that the covering 18 must be long enough to cover the shoes of most patrons while not being too long so as to make use thereof awkward or inconvenient. Preferably, the length should be between about 10 to 13 inches, depending on the overall cape length.

Figure 2:
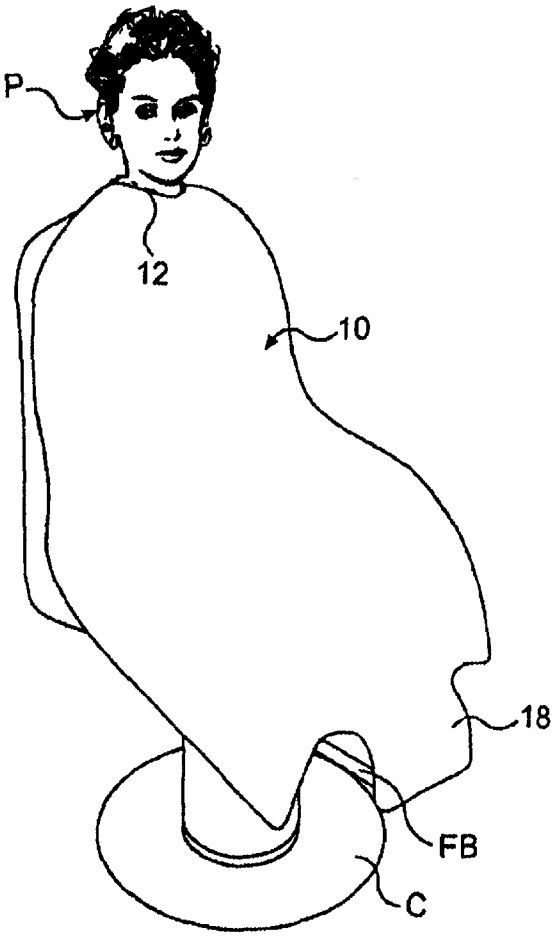
FIG. 2 is a schematic perspective view showing the cape of FIG. 1 in use.

Referring to FIG. 2, the cape 10 is shown in use. In FIG. 2, a patron or customer P is shown sitting on a conventional hair styling or barbering chair C. Chair C includes a standard footbar FB (only a portion of which can be seen) on which the feet of the patron rest. The cape 10 is initially fitted on the patron P in a conventional manner with the head extending through the neck opening 12 and the hooks and loops fastener strips 16 brought together to hold the cape in place on the patron. When the cape is initially put on, the foot protecting portion 18 would simply hang down in front, and to protect the shoes of the patron when the patron is seated as shown, portion 18 is draped over the shoes and slips around footbar FB so as to completely protect the shoes and thus eliminate the nuisance of hair falling into the shoes. The portion 18 is thus quite effective in serving its intended purpose while still being very easy to slip on and off.

Although it would be possible to sew or otherwise shape portion 18 so as to form a pouch for the feet and, further, to add elastic to an edge or edges to hold the pouch so formed on the feet, it has been found that, in general, most patrons prefer a simple covering because it is easy to put into place and is less confining and thus more comfortable.

Although the invention has been described above in relation to preferred embodiments thereof, it will be understood by those skilled in the art that variations and modifications can be effected in these preferred embodiments without departing from the scope and spirit of the invention.

What is claimed:

1. A hair cutting cape for use in cutting the hair of a person seated in a hair cutting chair including a foot bar on which the feet of the person rest, said hair cutting cape being constructed of a fabric suitable for hair cutting and comprising:

a main portion including a neck opening through which extends the head of the person whose hair is being cut, said main portion including first and second opposed edges and third and fourth opposed edges, said third and fourth edges being free of connecting means and said opening being disposed within said main portion at a location substantially equally spaced from said third and fourth edges and being spaced from the first edge an amount such that, in use of the cape, substantial portions of the cape fall over both the front and back of the person and such that a back portion can hang freely over the back of the chair and a front portion can be draped over the front of the person leaving the back of the legs, and back of the feet of the person uncovered by the front portion, and a foot covering portion extending outwardly from said second edge substantially central thereof, said foot covering portion being of a width substantially less than that of the second edge and being of size and configuration such that, in use, the foot covering portion can be slipped around the foot bar so as to overlie the feet of the person to thereby protect at least the tops of the feet of the person from falling hair while leaving uncovered at least those portions of the back of the legs and back of the feet in contact with the chair.

2. A cape as claimed in claim 1 wherein said main portion of the cape is substantially rectangular in shape.

3. A cape as claimed in claim 1 wherein said main portion includes a slit extending from said first edge to said neck opening.

4. A cape as claimed in claim 3 wherein opposed portions of the main portion adjacent to said slit include hooks and loops fasteners for securing said opposed portions together.

5. A cape as claimed in claim 1 wherein said foot covering portion is disposed centrally of said second edge of said main portion.

6. A cape as claimed in claim 1 wherein said foot covering portion has a free end of a substantially semicircular shape.

7. A cape as claimed in claim 1 wherein said foot covering portion is of a substantially rectangular shape.

8. A cape as claimed in claim 1 wherein said foot covering portion is of decreasing width in a direction away from said second edge.

9. A cape as claimed in claim 1 wherein said foot covering portion has a maximum width less than one-half of that of said second edge.

10. A cape as claimed in claim 1 wherein said foot covering portion has a length of between 10 and 13 inches.

* * * * *